United States Patent [19]

Tibbs

[11] 3,964,263

[45] June 22, 1976

[54] SIX CYCLE COMBUSTION AND FLUID VAPORIZATION ENGINE

[76] Inventor: Robert C. Tibbs, Hospital Drive, Cleveland, Miss. 38732

[22] Filed: Dec. 31, 1974

[21] Appl. No.: 537,657

[52] U.S. Cl. ..... 60/618; 60/712; 123/64; 123/25 C; 123/41.52; 123/193 CH; 123/37

[51] Int. Cl.[2] ..... F01K 27/00; F01B 29/04

[58] Field of Search ..... 60/618, 712; 123/64, 123/25 C, 41.17, 41.52, 191 B, 37, 191 R, 193 CH, 193 CP, 30 A, 32 J, 25 A, 25 B, 25 D

[56] References Cited

UNITED STATES PATENTS

| | | | |
|---|---|---|---|
| 771,881 | 10/1904 | Morrison | 123/30 A |
| 788,057 | 4/1905 | Morrison | 123/191 R |
| 924,100 | 6/1909 | Nichols | 123/191 R |
| 1,339,176 | 5/1920 | Dyer | 60/712 X |
| 1,424,798 | 8/1922 | Black | 60/712 X |
| 1,739,255 | 12/1929 | Niven | 123/193 CH |
| 2,030,894 | 2/1936 | Pennebaker | 123/191 S |
| 2,062,013 | 11/1936 | Opolo | 123/193 CH |
| 2,248,989 | 7/1941 | Hanson | 123/191 R |
| 2,671,311 | 3/1954 | Rohrbach | 123/25 C X |
| 3,882,841 | 5/1975 | Silverstein | 123/193 CP |

FOREIGN PATENTS OR APPLICATIONS

| | | | |
|---|---|---|---|
| 179,954 | 3/1923 | United Kingdom | 123/256 |
| 214,697 | 4/1924 | United Kingdom | 123/64 |

*Primary Examiner*—Charles J. Myhre
*Assistant Examiner*—William C. Anderson
*Attorney, Agent, or Firm*—Clarence A. O'Brien; Harvey B. Jacobson

[57] ABSTRACT

A reciprocating piston engine of the type including a piston reciprocal in a cylinder toward and away from an expansion chamber at one end of the cylinder and also provided with intake and exhaust valves openable and closable in timed sequence with reciprocation of the piston. The valves are closed during the compression and power strokes of the piston and the exhaust valve is opened during the third stroke of the piston toward the expansion chamber. During the fourth stroke of the piston, a readily vaporizable liquid is injected into the expansion chamber under pressure for flashing into a vapor upon being heated by the residue heat of combustion in the expansion chamber and during the fifth and sixth strokes of the piston the exhaust and intake valves, respectively, are open to exhaust the vaporized liquid therefrom and intake a fresh combustible mixture of air and fuel into the expansion chamber and cylinder prior to compression of the mixture on the next stroke of the piston toward the expansion chamber. Also, the expansion chamber and piston include a plurality of fin portions for absorbing considerable quantities of heat during the combustion power stroke and the combustion gas exhaust stroke of the engine whereby sufficient residue of heat is retained within the combustion chamber for substantially instantly flashing the vaporizable liquid injected thereinto during the fourth stroke of the piston into a vapor.

4 Claims, 3 Drawing Figures

SIX CYCLE COMBUSTION AND FLUID VAPORIZATION ENGINE

BACKGROUND OF THE INVENTION

Various types of 6 cycle reciprocating piston internal combustion engines as well as engines including some of the basic concepts of the instant invention have been heretofore designed and examples of these prior art devices are disclosed in U.S. Pat. Nos. 1,078,816, 1,292,882, 1,474,954, 1,559,931, 1,711,937, 2,536,238, 2,671,311, 3,336,746 and 3,783,841.

However, these prior art devices have not been specifically designed with simplicity of structure and operation as major considerations with regard to the overall concept of providing an engine which will be capable of developing increased power for a given amount of hydrocarbon fuel consumed and which will thus function to conserve petroleum fuels. In addition, these previously known devices have not been designed as a means to reduce air pollutants.

BRIEF DESCRIPTION OF THE INVENTION

The combustion engine of the instant invention has been designed primarily to provide an engine which will develop a greater amount of power per unit of hydrocarbon fuel consumed and is further designed in a manner such as to reduce exhaust pollutants. Although the exhaust system of the engine is not specifically disclosed herein, it is to be understood that its exhaust system will include structure for condensing water from the exhaust of the engine and with the process of condensing water from the exhaust gases being constructed in a manner as to wash the exhaust gases. After the water condensed from the exhaust gases has been used to wash the latter, it may be collected and filtered for reuse in the engine.

The main object of this invention is to provide a reciprocating piston combustion engine constructed in a manner whereby the engine will be of the 6 cycle type and appreciable portions of the residue of the heat of combustion will be maintained within the expansion chamber of the engine to the end of the exhaust stroke thereof and finely atomized water may be injected into the expansion chamber at the end of the exhaust stroke for instant flashing into steam to thereby again increase the pressures within the expansion chamber for driving the piston of the engine through a second power stroke and subsequent exhaust stroke between the exhaust stroke for exhausting the residue of combustion from the engine and the intake stroke for intaking a fresh air and fuel mixture into the combustion chamber prior to the compression and subsequent power stroke of the piston as a result of the burning of a mixture of air and fuel in the combustion chamber.

Another object of this invention is to provide an engine which may include an exhaust system for reclaiming the water injected into the expansion chamber in a manner such that the combustion gases exhausted from the engine may be cleansed of air pollutants.

A final object of this invention to be specifically enumerated herein is to provide a 6 cycle combustion and fluid vaporization engine in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
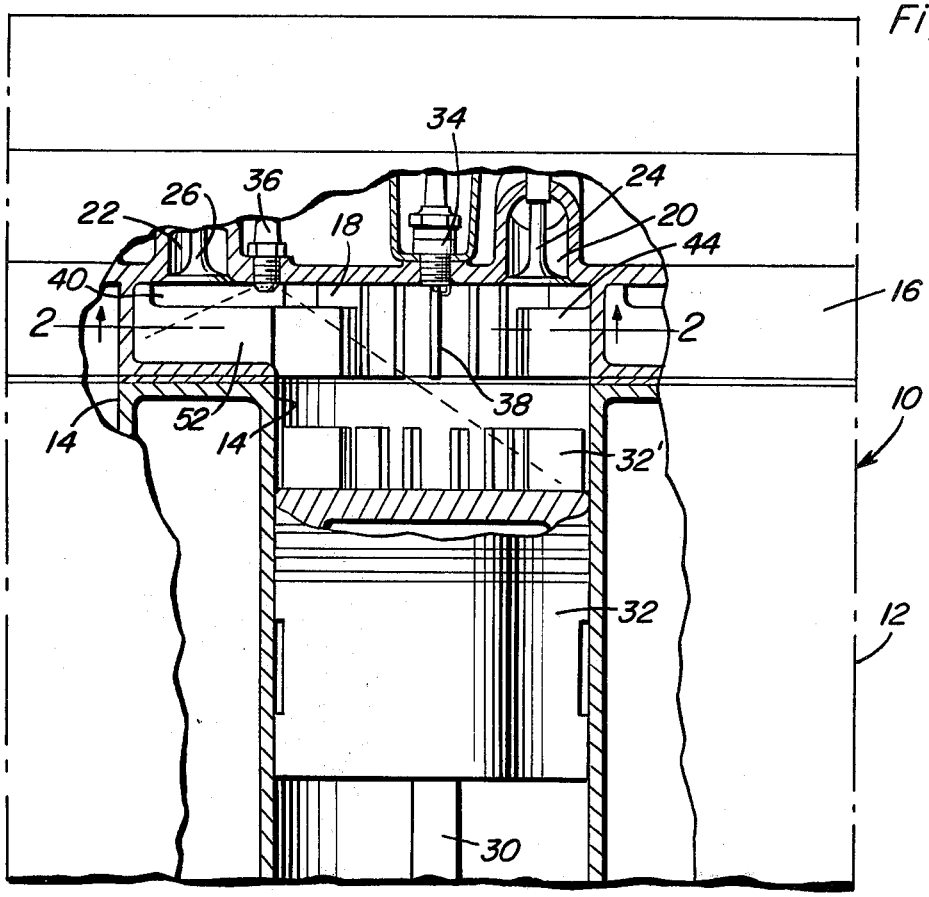
FIG. 1 is a fragmentary elevational view of an engine constructed in accordance with the present invention and with portions thereof being broken away and illustrated in vertical section.

Referring now more specifically to the drawings, the numeral 10 generally designates an engine constructed in accordance with the present invention. The engine 10 includes a multi-cylinder block 12 having a plurality of cylinder bores 14 formed therein and the upper ends of the bores 14 are closed by means of a cylinder head 16 having expansion chambers 18 formed therein in registry with the upper ends of the bores or cylinders 14. The expansion chambers 18 include inlet ports 20 and exhaust ports 22 and the usual poppet valves 24 and 26 are provided for opening and closing the ports 20 and 22 in timed sequence.

The engine 10 further includes a crankshaft 28 and a plurality of connecting rods 30 are provided and operably connect a plurality of pistons 32 reciprocal in the bores 14 to the crankshaft 28. The valves 24 and 26 are actuated in timed sequence with reciprocation of the pistons 32 and each expansion chamber 18 further includes a spark plug 34 projecting thereinto and a high pressure atomizing nozzle 36 which opens thereinto. As is conventional, the spark plugs 34 are actuated by conventional distributor means and the atomizing nozzles 36 may be actuated by a suitable combined pressure and distributor type pump.

Figure 2:
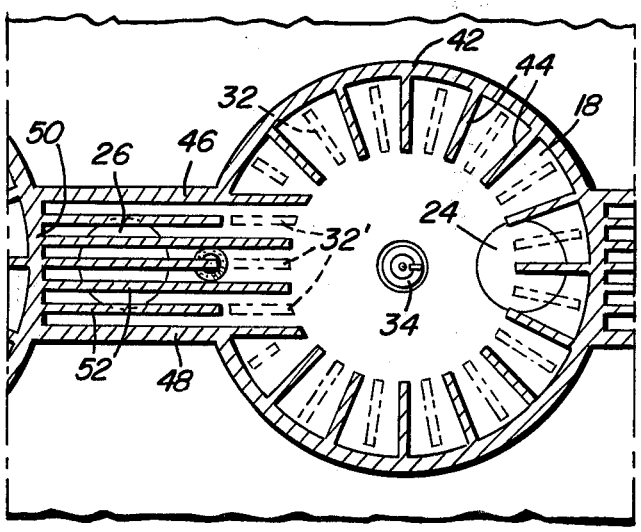
FIG. 2 is a fragmentary horizontal sectional view taken substantially upon the plane indicated by the section line 2—2 of FIG. 1.

From FIG. 2 of the drawings it may be seen that the expansion chambers 18 include portions 38 thereof in alignment with the adjacent ends of the corresponding bores and portions 40 thereof which extend laterally to one side of the corresponding bores 18 and underlie the exhaust ports 22. The portions 38 include partial cylindrical boundary walls 42 including radially inwardly projecting fins 44 and the portions 40 include parallel opposite side walls 46 and 48 joined together at their ends remote from the portion 38 by means of a right angularly disposed end wall 50. Further, each portion 40 includes a plurality of parallel vertical fins 52.

Figure 3:
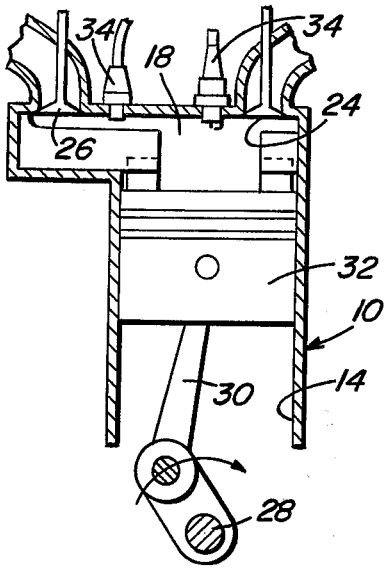
FIGS. 3 through 8 of the drawings comprise sectional schematic views of one cylinder of the engine illustrating the movable components of the engine operatively associated with that cylinder in their respective positions during the six stroke cycles of the engine.
Figure 4:
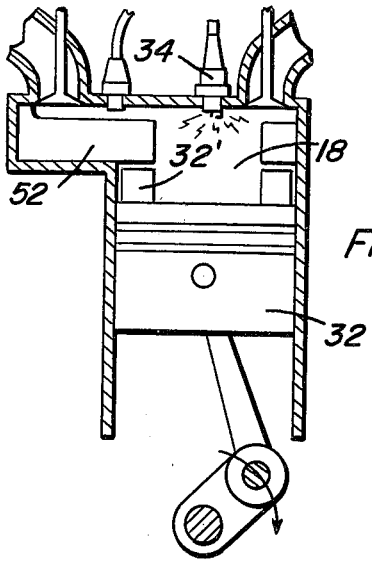
Figure 5:
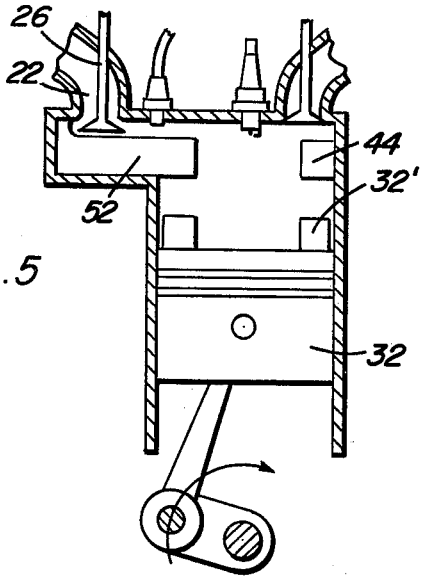
Figure 6:
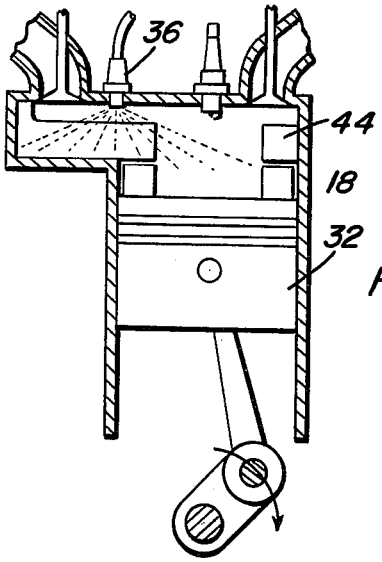
Figure 7:
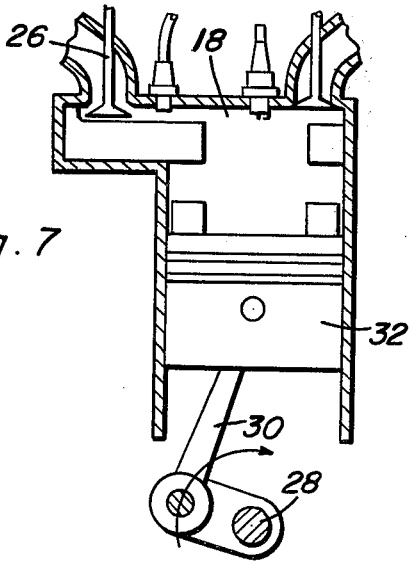
Figure 8:
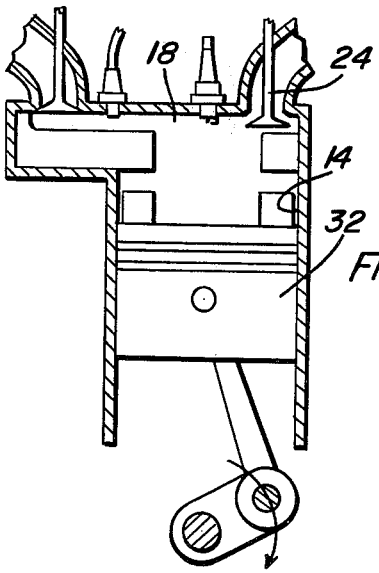

With attention now invited more specifically to FIGS. 3 through 8 of the drawings, it may be seen that in FIG. 3 of the drawings the piston 32 is on its upward stroke at the end of the compression stroke of a combustible mixture of air and fuel within the expansion chamber 18. In FIG. 4 of the drawings the piston 32 is illustrated on its downward power stroke and the spark plug 34 is actuated to ignite the combustible mixture in the chamber 18 when the piston nears the completion of its upward stroke during the compression cycle. As a result of the burning of an air and fuel mixture within the combustion chamber or expansion chamber 18 the piston 32 is forced downwardly in the manner illustrated in FIG. 4 through its first power stroke. Then, after the piston 32 reaches its downward limit of travel and begins its next upward movement of travel as illustrated in FIG. 5 of the drawings, the exhaust valve 26 is opened and the piston 32 forces the burning gases of combustion out through the exhaust port 22. During the power stroke illustrated in FIG. 4 and the exhaust stroke illustrated in FIG. 5 the fins 44 and 52 are subject to the extreme temperature which are created within the expansion chamber 18 and absorb considerable amounts of heat. Then, as the piston 32 completes its upward stroke as illustrated in FIG. 5 the exhaust valve 26 closes and a readily vaporizable liquid is injected into the expansion chamber 18 through the nozzle 36. The nozzle 36 is capable of injecting liquid into the expansion chamber 18 in a finely atomized form and this highly atomized and readily vaporizable liquid is substantially immediately flashed into a vapor in order to again increase the pressure within the expansion chamber 18 and this increase in pressure within the expansion chamber 18 drives the piston 32 downwardly through its second power stroke illustrated in FIG. 6. Thereafter, after the piston 32 reaches its limit of downward movement as a result of its second power stroke, the piston 32 moves upwardly through its second exhaust stroke and the exhaust valve 26 is again opened to exhaust the vapors from within the bore 14 and the expansion chamber 18. Thereafter, when the piston 32 has completed its second upward stroke and begins its next downward stroke, the intake valve 24 opens and a fresh charge of air and fuel is drawn into the expansion chamber 18 and the cylinder bore 14 preparatory to that charge being compressed after the intake valve 24 closes at the bottom of the stroke of the piston 32 and the next upward movement of the piston 32 as illustrated in FIG. 3.

The considerable quantities of heat of combustion within the expansion chamber 18 absorbed by the fins 44 and 52 enables the readily vaporizable liquid such as water injected into the expansion chamber 18 through the nozzle 36 to be substantially instantly flashed into steam. Further, inasmuch as the heat required to flash the atomized water into steam comprises the residue of the heat of combustion which is normally dissipated by air cooling fins on an engine or cooling water in a liquid jacketed engine, there is no need to provide for the usual cooling of the engine 10. Still further, inasmuch as the heat absorbed from the fins 44 and 52 during the process of flashing the atomized water into steam is substantially complete, there are no "hot spots" remaining in the expansion chamber 18 after the exhaust stroke of steam therefrom and predetonation of the air and fuel subsequently inducted into the chamber 18 on the next intake stroke is avoided. Still further, a slight residue of steam remains in the expansion chamber 18 at the beginning of the intake stroke for air and fuel and the moisture content of this steam serves to further increase the power developed during the power stroke illustrated in FIG. 4 in the same manner as that experienced by conventional reciprocating piston combustion engines equipped with water injection. Also, the head of the piston 32 includes integral upwardly projecting radial fins 32' and fins 32'' which are received between fins 44 and 52 when the piston 32 is positioned in the upper portion of the bore 14.

Figure 9:
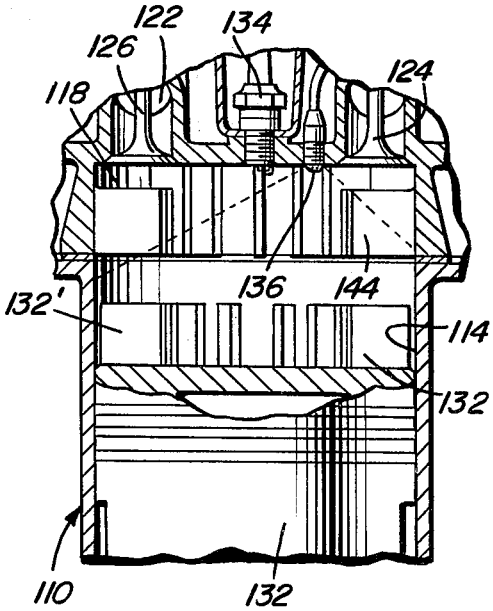
FIG. 9 is a fragmentary vertical sectional view similar to FIG. 1 but illustrating a modified form of the engine.

With reference now more specifically to FIG. 9 of the drawings, there may be seen a modified form of engine constructed in accordance with the present invention and which is generally designated by the reference numeral 110. The engine 110 includes many components similar to the engine 10 and which are designated by corresponding numerals in the 100 series.

The engine 110 differs from the engine 10 in that the expansion chamber 118 thereof includes only the portion corresponding to the portions 38 disposed in direct alignment with the adjacent end of the cylinder bore 114 and does not include a portion corresponding to the portion 40. Also, the nozzle 136 is located between the intake valve 124 and the spark plug 134 and the exhaust valve 126 and exhaust port 122 are located in that area of the engine 110 corresponding to the area of the engine 10 between the spark plug 34 and the nozzle 36. Otherwise, the operation of the engine 110 is substantially identical to the operation of the engine 10.

As hereinbefore set forth, the spark plug 34 may be actuated by a conventional distributor driven from the crankshaft 28 and the various intake and exhaust valves 24 and 26 may be camshaft operated with the camshaft also driven from the crankshaft 28. Further, the high pressure pump and distributor system for the nozzle 36 may also be driven from the crankshaft 28 in any conventional manner.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In a combustion engine of the type including a cylinder having a piston reciprocal therein and defining an expansion chamber at one end of said cylinder in constant communication therewith and equipped with intake and exhaust valve means, said expansion chamber having a plurality of heat absorptive fin portions therein, said piston having a plurality of heat absorptive fin portions thereon which project into said chamber during the end portions of the strokes of said piston in said cylinder toward and away from said chamber, injection means operative to inject a measured quantity of atomized readily vaporizable liquid into said expansion chamber for contact with said fin portions, said engine being of the 6-stroke cycle type including a first intake stroke during which said intake and exhaust valve means are open and closed, respectively, second and third compression and power strokes during which said intake and exhaust valve means are closed, a fourth stroke during which said intake and exhaust valve means are closed and open, respectively, a fifth stroke during which said intake and exhaust valve means are closed and said injector means is operable to inject atomized liquid into said expansion chamber, and a sixth stroke during which said intake and exhaust valve means are closed and open, respectively, said fin portions on said piston and at least a majority of said fin portions in said chamber being disposed, at least generally, in radial planes of the center axis of said cylinder, the piston fin portions and said majority of fin portions in said chamber being disposed in spaced overlapped interdigitated relation during the end portions of the strokes of said piston toward and away from said chamber at the adjacent end of said cylinder, said fin portions on said piston and said fin portions in said chamber being spaced radially outwardly from the longitudinal center line of said cylinder, and ignition means communicated with the interior of said chamber at a point spaced inwardly of the radial innermost ends of said fin portions.

2. The combination of claim 1 wherein said expansion chamber is limited to an area at least substantially entirely within the confines of extensions of the adjacent end portions of the surfaces of said cylinder.

3. The combination of claim 1 wherein said expansion chamber includes a lateral extension projecting laterally outwardly beyond one side of said cylinder, said exhaust valve means being disposed within said extension and some of said chamber fin portions extending in generally parallel paths between said exhaust valve means and the adjacent end of said cylinder.

4. The combination of claim 3 wherein said injector means opens into said expansion chamber between said exhaust valve and the center axis of said cylinder.

* * * * *